United States Patent [19]

Garrett et al.

[11] 4,285,406

[45] Aug. 25, 1981

[54] DRILLING HEAD

[75] Inventors: William R. Garrett, Conroe; David E. Young, Friendswood, both of Tex.

[73] Assignee: Smith International, Inc., Newport Beach, Calif.

[21] Appl. No.: 69,360

[22] Filed: Aug. 24, 1979

[51] Int. Cl.[3] ..... E21B 3/04

[52] U.S. Cl. ..... 175/195; 277/31; 285/363

[58] Field of Search ..... 175/195, 214, 210; 277/31; 285/363; 166/82, 84, 78

[56] References Cited

U.S. PATENT DOCUMENTS

| | | | |
|---|---|---|---|
| 3,023,012 | 2/1962 | Wilde | 277/31 |
| 3,387,851 | 6/1968 | Cugini | 277/2 |
| 3,400,938 | 9/1968 | Williams | 175/214 X |
| 3,529,835 | 9/1970 | Lewis | 277/31 X |
| 3,661,409 | 5/1972 | Brown | 285/367 |
| 4,154,448 | 5/1979 | Biffle | 277/31 |

OTHER PUBLICATIONS

Page 4940, "Composite Catalog of Oilfield Equipment and Services", Rucker-Shaffer Rotating BOP, 1976-1977.

*Primary Examiner*—William F. Pate, III

*Attorney, Agent, or Firm*—Murray Robinson; Ned L. Conley; David A. Rose

[57] ABSTRACT

A drilling head includes a tubular body with top, bottom and side openings.

A top closure closes the annulus between a portion of the head above the side opening and a drive tube such as a kelly extending through the head. The top closure includes a rotor, adapted to form a non-rotating seal with the kelly, and a stator, with a rotating seal between the stator and rotor. The stator is supported on and releasably connected to the body. The rotor includes a seal tube rotatably supported by inboard bearings on the stator located above the rotating seal.

The seal tube has a replaceable rubber stripper to seal with the kelly. An upwardly flaring medial flange on the stripper guides upwardly flowing annulus fluid toward the side opening and away from the rotating seal.

The rotor includes an elastomer sandwich drive bushing, rising above the stator into the rotary table, splined to the seal tube and secured to the kelly by slips.

A segmented clamp securing the top closure to the body includes more than two segments, for fast actuation, and the segments are guided so that but one motor is required to operate all segments.

The segmented clamp securing the top closure stator to the drilling head body is tightened and released by a remote controlled, rotary hydraulic motor driven screw, which is also manually actuatable.

The stator has a tapered pin fitting into a conical bowl in the body with spaced upper and lower seals therebetween. The rotating seal is supplied with lubricant from outside the body via passages through the bushing and stator and body, communicating across the pin and bowl between the two seals.

5 Claims, 19 Drawing Figures

(ROTATING SEAL LUBRICATION)

(STRIPPER)

(DRIVE BUSHING)

(ROTATING SEAL)

(BEARING DRIVE BUSHING REMOVED)

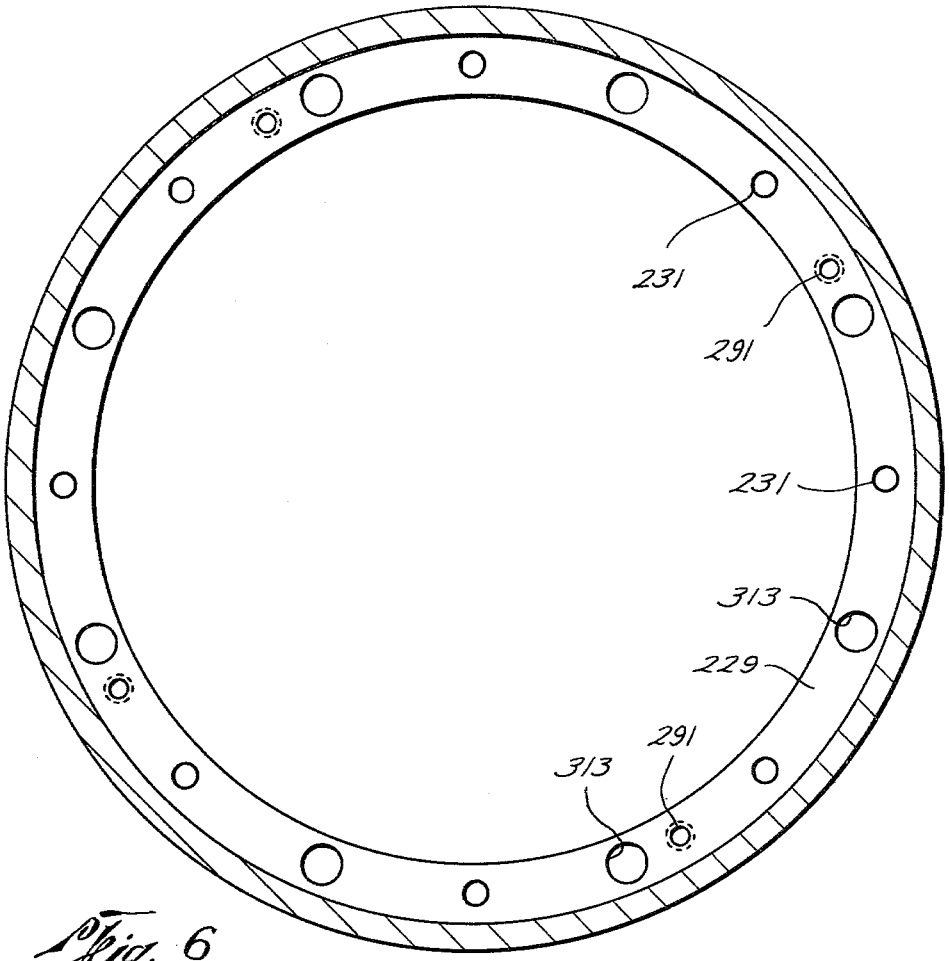
Fig. 6
Fig. 7
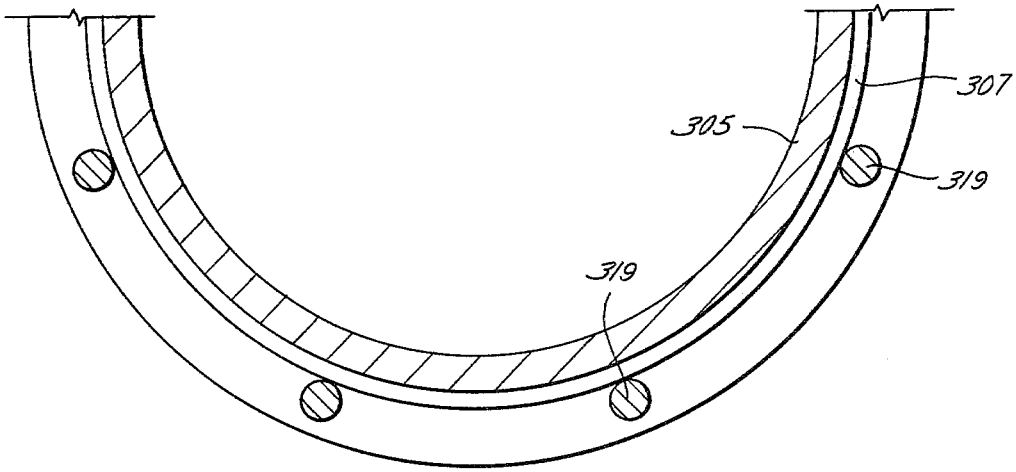

DRILLING HEAD

CROSS-REFERENCES TO RELATED APPLICATION

This application is one of three contemporaneously filed related applications, all assigned to the same assignee, which disclose the joint and sole inventions of William R. Garrett and David E. Young, which are embodied in a particular drilling head hereinafter disclosed and sometimes referred to as the composite drilling head, the joint and sole inventions sometimes hereinafter being referred to together as the composite inventions. The other two applications are Ser. No. 69,341 (Garrett) and Ser. No. 69,324 (Young).

COMPARISON OF COMPOSITE INVENTIONS AND ANOTHER INVENTION

The composite drilling head is of the type in which the bearings are removed with the seal tube through the master bushing receiving opening of the rotary table when the seal tube is to be refurbished. Also, the rotating seal stator is removed with the seal tube. The shock absorber is incorporated in the drive bushing, being disposed above the seal tube and splined thereto. The side outlet is removable from the rest of the head. Separate means are employed to retain the rotating and non-rotating seals on the seal tube.

A companion application, assigned to the same assignee, filed contemporaneously herewith by William R. Garrett (U.S. Ser. No. 69,323), discloses a drilling head of the type in which the bearings are not usually removed with the seal tube through the master bushing receiving opening of the rotary table when the seal tube is to be refurbished, although if it is desired to remove the bearings, that too can be done when the master bushing is removed. The rotating seal stator is not removed with the seal tube nor with the bearings. The shock absorber is integral with the seal tube. The side outlet is flush and integral with the body of the head. Common means are employed for retaining the rotating and non-rotating seals on the seal tube.

BACKGROUND OF THE INVENTION

This invention relates to equipment useful in earth boring by the rotary system wherein a drill bit is rotated in an earth bore by means of a drill stem. The drill stem comprises a string of tubular members including a plurality of lengths of drill pipe and at the upper end of the pipe string a drive tube. The drive tube is sometimes just another length of pipe, but more often is a non-circular cross-section tube called a kelly. The drive tube is connected to drive means for rotating the drive tube.

Sometimes the drive means is an electric or hydraulic motor geared to the rotating part of a swivel by means of which the drill stem is suspended from the travelling block of a derrick. Such a motor means is called a power swivel.

More often the drive means is a rotary table. A rotary table includes a body having a hole in the middle through which the drive tube extends, torque means to connect the body to the drive tube so that rotation of the body will cause rotation of the drive tube about its axis, and a hydraulic or electric or other motor connected directly or indirectly to the body to rotate the body. Although other arrangements are known, usually the torque means comprises bushing means secured against rotation in the body and having a polygonal aperture through which the drive tube extends, in which case the drive tube is of correlative polygonal cross-section and is known as a kelly. The torque means then may comprise a master bushing received in the hole through the body of the rotary table and a kelly bushing received in the master bushing and slidably engaging the kelly. The kelly bushing is split so that it can be removed from one kelly and put on another whenever desired. Normally, however, during the several weeks during which an earth bore is being made, the kelly bushing remains always connected to one kelly, being prevented from slipping off the ends because the tool joint type connectors at the ends of the kelly are too large to pass through the kelly bushing.

During drilling by the rotary system, the body of the rotary table is turned, rotating the bushings and the kelly and the drill pipe therebelow, and thus rotating the drill bit at the bottom of the hole. Drilling fluid, either aeroform or liquiform, such as air or mud, is pumped down the drill stem, out the bit, and back up the annulus between the earth bore and drill stem. The upper part of the earth bore is usually lined with steel pipe called surface casing, cemented in place in the earth bore. Surmounting the casing and connected thereto by a screw thread connection or a flange connection are one or more steel spools called well heads having side outlets through which access can be had to the annulus, the lowermost spool being connected to and supported by the surface casing and each spool thereabove being connected to the spool therebelow. Each spool may be provided with a conical bowl in which is supported a tapered coupling or hanger on another string of casing of smaller diameter extending farther down in the earth bore, the earth bore getting smaller in diameter as it goes deeper.

During drilling, as soon as the bore reaches a substantial depth, a spool forming the body of a large gate valve, known as a master valve, and one or two additional spools each known as a blow-out preventer (BOP) are added to the top of the stack of well heads. Such a stack may be called the control stack. In case the earth bore penetrates a high pressure formation tending to blow the drill stem and drilling fluid out of the earth bore, movable portions of one of the preventers may be moved to close off the annulus between the drill stem and body of the blowout preventer, the preventer closing tightly about the drill stem so that the tool joints connecting its components, which are of larger diameter than the kelly or drill pipe, cannot pass through the preventer. Or if the drill stem is removed, another preventer or the master valve can be closed to completely block off the whole earth bore.

The stack of well heads and preventers may be ten feet high. The rotary table is mounted on a structure located above the top of the control stack, usually on the floor of a drilling rig erected over the site of the earth bore, such rig carrying also the derrick, drawworks, drilling fluid pumps, and pipe racks.

In the course of drilling, two operations occur regarding handling of the drill pipe. As the bore deepens, the kelly is lowered through the rotary table until the tool joint member or connector at the upper end of the kelly contacts the kelly bushing, preventing further lowering. The drill string is then elevated to bring the upper end of the uppermost length of drill pipe above the rotary table. This causes the kelly bushing to be withdrawn from the master bushing, the kelly bushing having too small an opening for the connector at the lower end of the kelly to pass through the kelly bushing. Slips are then set in the conical bowl of the master bushing to grip the drill pipe and support it in the rotary table. The kelly is unscrewed from the drill pipe, employing tongs and with the assistance of a cat line connected to a winch. The kelly is then put to one side, and another length of drill pipe is connected to the upper end of the drill string, and the string is picked up with elevators connected to the draw works. The slips are removed and the drill string lowered back into the earth bore until only the upper end of the last added length of pipe is above the rotary table. The pipe is then suspended from the table by slips placed in the master bushing, the elevators are released from the pipe and used to pick up the kelly. The kelly is then reconnected to the upper end of the drill string, the string is suspended by the elevators, the slips are removed, the kelly bushing is lowered into the master bushing, and drilling is resumed. This operation is called adding pipe.

Periodically, the drill bit wears out and must be replaced. In such case, the kelly is removed as in the case of adding drill pipe, and then all the drill pipe is pulled out of the earth bore, one or more lengths at a time, and racked at the side of the drill rig. Finally, the last lengths of pipe, usually pipes of greater wall thickness called drill collars, are removed, and lastly the drill bit. A different bit is then substituted and the drill string is put back into the earth bore, one or more lengths at a time. This operation is called "making a trip" or "tripping".

In the course of drilling, the drilling mud is picked up from the mud pit by a slush pump and pumped through a hose to the swivel and down the kelly and the rest of the drill string and the bit and back up the annulus and then through a side outlet in a well head to a flow line going to a shale shaker and then back to the mud pits. Such circulation is discontinued, however, during tripping and when adding pipe. When the kelly and kelly bushing are lifted out of the master bushing, the rig floor is exposed to the open top of the earth bore annulus therebelow. Any momentary pressure rise in the well may cause mud to emerge like a fountain through the rig floor. Or if circulation is maintained while the kelly is pulled up out of the table, upflowing mud in the annulus may splash out of the top of the well head and through the open rotary table out the rig floor. In the case of air drilling, detritus entrained with the air will tend to blow up through the table onto rig personnel performing the tripping or adding pipe operation. Even during regular drilling, mud splashing out of the top of the uppermost well head or bell nipple will make a mess in the neighborhood of the control stack, and in the case of air drilling returning detritus laden air will blast the underside of the rotary table if not controlled.

To prevent such uncontrolled flow of drilling fluid returning from the annulus under the conditions just described, a special well head known as a diverter may be employed to seal off the annulus at the upper end of the control stack. If it is desired to maintain the returning drilling fluid under pressure, as in pressure drilling, a similar device capable of withstanding greater annulus pressure may be employed, such a device being called a rotating blowout preventer. Both diverters and rotating preventers are known under the generic name of drilling heads.

The composite inventions relate to an improved drilling head. Drilling heads are well known in the prior art. Generally a drilling head includes a seal tube rotatably mounted in the spool or body of the head and having a stripper rubber slidably but non-rotatably engaging the kelly and a rotating seal between the seal tube and spool. A split drive bushing engages the kelly and seal tube to rotate the seal tube with the kelly to avoid relative rotation therebetween. Various arrangements are provided for replacing the stripper rubber, the seals, and the bearings, and for lubricating and sealing the bearings, as discussed further in the aforementioned companion application of W. R. Garrett.

An object of the composite inventions is to provide a drilling head made of a multiplicity of components which can be assembled and separated in an improved manner to facilitate installation, operation, and maintenance of the drilling head. Further and more specific objects will appear as the description of the composite inventions proceeds.

SUMMARY OF THE INVENTION

According to the composite inventions the drilling head includes a body or spool having a removable side outlet which enables the head to be installed at the top of the control stack by lowering it through the rotary table after removing the master bushing. The removability of the side outlet also facilitates installation, and removal for replacement, of a hard metal liner for the outlet, which takes the wear of the detritus rounding the corner from the annulus into the side outlet.

Further to reduce wear from the detritus entrained in the drilling fluid, the stripper is provided with a horizontally extending or radial medial flange which extends out beneath the rotating seal and bearings.

The upper part of the stripper is bonded to a metal support sleeve which has a tapered upper end forming a pin which is received in an inverted conical seat in the bottom of the seal tube body. The pin is wedged into the bowl by a circle of cap screws engaging a split ring that bears at its inner periphery against a narrow external flange on the support ring, the cap screw extending past the flange into the seal tube body.

The flange on the stripper is provided with access holes aligned with the cap screws so that a wrench can be passed through the flange to release the cap screws when it is desired to remove or replace the stripper. However, if the cap screws should fall out accidentally during operation, the screws are too large to pass through the holes in the stripper flange and are retained thereon, preventing junking of the earth bore.

The upper surface of the stripper flange is provided with orienting lugs to position the two halves of the split ring with the holes in the split ring aligned with the holes in the flange. The upper surface of the flange is also provided with elevator lugs to hold the split rings in engagement with the support sleeve flange.

The tapered pin on the metal support sleeve of the stripper makes a tight fit with the correlatively tapered seat in the seal tube body when the cap screws are tightened, thereby to avoid any wobble and wear.

The rotating seal packing, a series of annular lip seals with annular internal backup rings forming a seal cartridge, is clamped to the seal tube body by means of a packer support sleeve having an internal flange urged toward the body by a circle of cap screws alternating with those which hold the stripper support sleeve in place. The two support sleeve flanges are superimposed, one above the other. The retainer screws for the split ring, securing the stripper support sleeve to the seal tube pass without threaded engagement through unthreaded holes in the packing support sleeve in between the unthreaded holes through which pass the screws that hold the packing support sleeve. There is also a set of threaded holes through the flange on the packing support sleeve. If the packing support sleeve should stick to the seal tube body after the retaining screws are removed, it can be jacked free by screws which are screwed through the threaded holes and press against the seal tube body.

The rotating seal stator is connected to the bearing stator to be removed therewith when the seal tube and bearings are removed, so that the stator wear bushing can be more easily replaced. A conical seat in the body of the head receives the seal stator and thus supports the whole seal tube bearing assembly and centers it in the body of the head and facilitates a stationary seal therebetween.

The rotating seal is lubricated via a lubricant passage which extends through the seal stator and terminates in the body of the drilling head, so that when the seal stator is removed with the seal tube it is not necessary to remove the connection from the body to the lubricator, which would require someone to work under the rig floor below the rotary table.

The seal tube and bearing assembly is connected to the body of the head by a fast acting clamp. The clamp, which can also be operated manually in emergencies, is normally operated by a motor with remote control, for quick release and reattachment without the necessity for a workman to go under the rig floor. The clamp motor is of a type which does not release when the motor fluid power fails, thereby assuring that the head will not unexpectedly become disassembled.

The clamp incorporates more than two segments to facilitate quick release, and guides are provided to cause all segments to move radially in and out together even though but a single motor is employed located at one side of the head.

When it is desired to replace the drill bit, or other drill string member which is too large to pass through the stripper, the master bushing is removed from the rotary table and the seal tube and bearing assembly are removed through the rotary table without any need for anyone to go below the rig floor to release the clamp or to disconnect the seal lubricator. The seal tube and bearing assembly will pass through even small rotary tables that are too small to pass the body of the drilling head.

Since the bearings and stripper and rotating seal are all part of the one removable assembly, they can all be serviced or replaced as may be required whenever the assembly is withdrawn for bit replacement. This consolidation of elements in one assembly is facilitated by incorporation of the shock absorber in the drive bushing and the placement of the drive bushing above the seal tube, releasably connecting the drive bushing to the seal tube by a spline. The annular, elastomer sandwich, shock absorber may be molded with off axial holes in the elastomer to prevent pressure build up under the drive bushing. These holes also reduce molding stresses.

To connect the drilling head to the next adjacent head of the drilling control stack, usually a blowout preventer, the drilling head body is provided at its lower end with a flange through which extends a set of bolt holes. When the flange is bolted to the preventer flange, a steel ring gasket therebetween seals the head to the preventer. To adapt the head to different sizes of preventers, two sets of bolt holes are provided in the flange and the lower inner periphery of the flange is provided with a rabbet in which is received a selected one of two adapter rings having different diameter annular grooves to receive different diameter ring gaskets, the adapter ring being secured to the flange by cap screws and sealed thereto by an O-ring.

BRIEF DESCRIPTION OF DRAWINGS

For a detailed description of a preferred embodiment of the composite invention, reference will now be made to the accompanying drawings wherein:

FIGS. 6, 7, and 8 are fragmentary sections taken at plane 6—6, 7—7, and 8—8;

Figure 10:
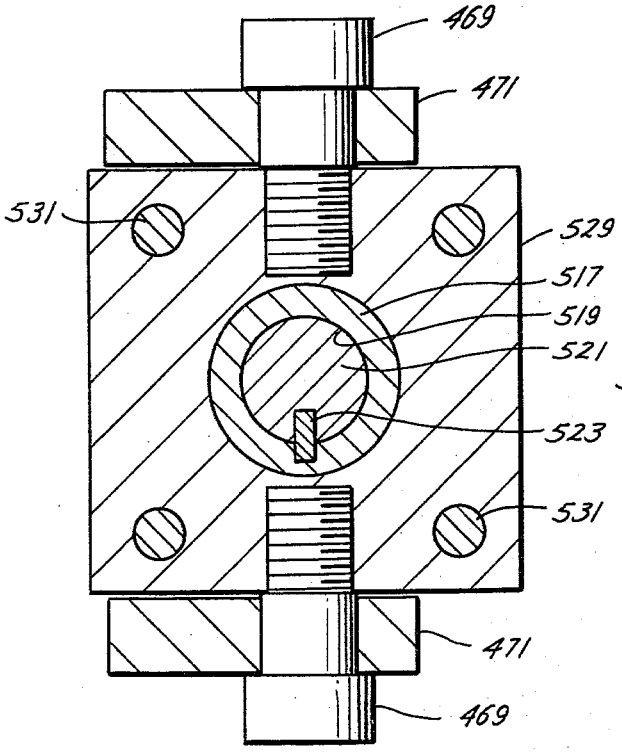

Except for FIG. 10 the drawings are to scale; the conventions of the United States Patent & Trademark Office for patent cases relative to indication of materials are employed, the metal parts being made of steel except as otherwise noted hereinafter.

DESCRIPTION OF PREFERRED EMBODIMENT

Body

Figure 1:
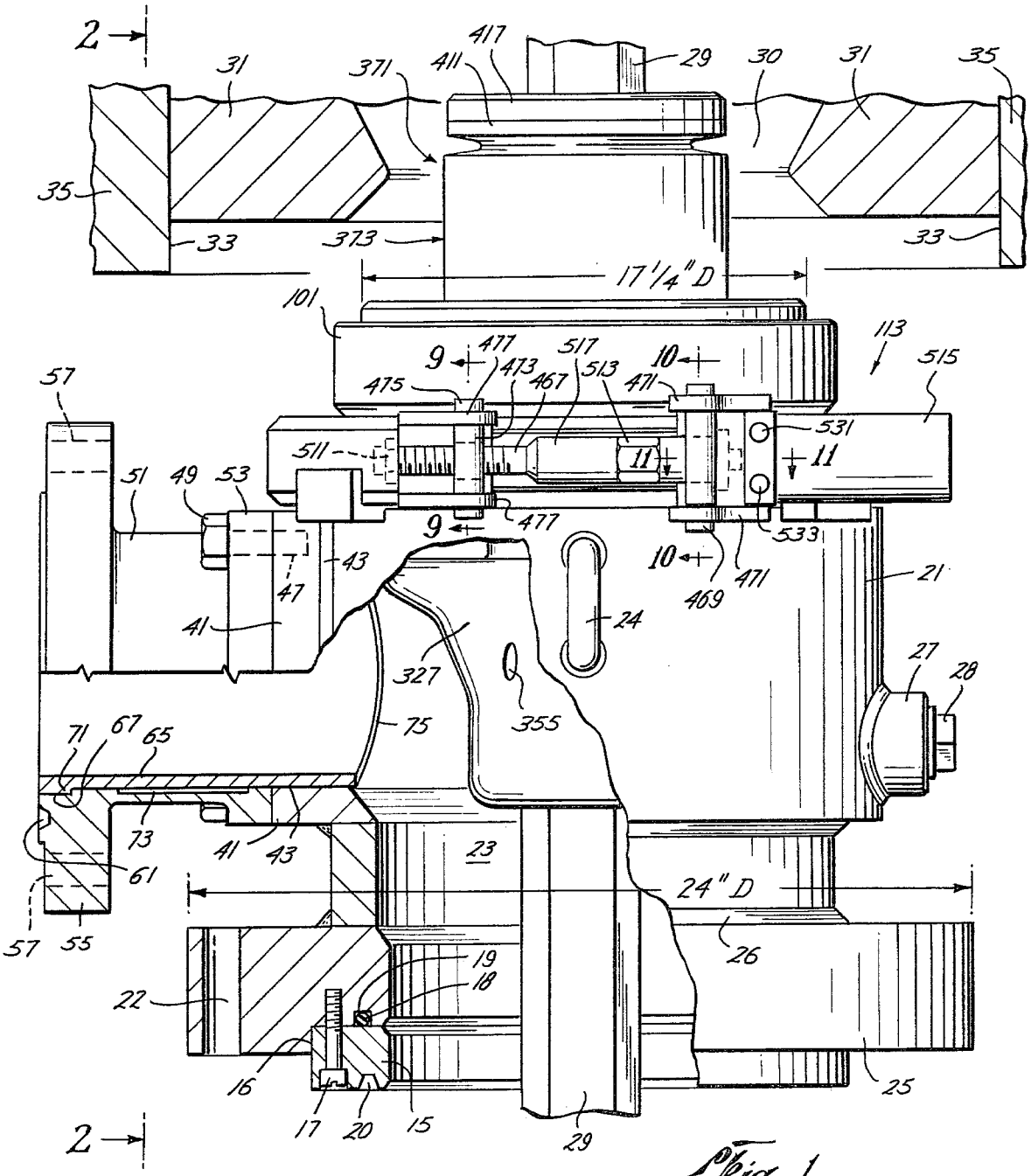
FIG. 1 is an elevation, partly in section, showing a drilling head incorporating the composite invention.

Referring now to FIG. 1 there is shown a drilling head including a tubular body 21 with a vertical flow passage 23 therethrough. Lifting eyes 24 are welded to the sides of the body. A radial flange 25, welded to the body at 26, provides means for connecting the head to the upper end of a drilling control stack, e.g. to the top flange of a blowout preventer. There are two sets of circumferentially spaced holes 22, 22' through the flange to receive bolts by means of which flange 25 is releasably secured to a larger or smaller companion flange at the top of the control stack. Set of bolt holes 22 is for a nominal $13\frac{5}{8}$ inch diameter 5,000 psi preventer; set of holes 22' is for a nominal 12 inch diameter, 3,000 psi preventer. Holes 22 and 22' merge in some cases.

Figure 1A:
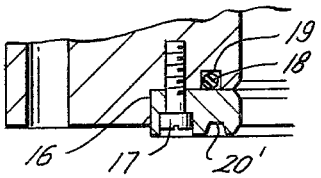
FIG. 1A is a fragmentary section similar to FIG. 1 showing an adaptation.

An adapter ring 15 is secured in annular rabbet 16 at the lower inner periphery of flange 25 by a plurality of circumferentially spaced cap screws 17. Ring 15 is sealed to flange 25 by O-ring 18 disposed in trapezoidal groove 19. An annular groove 20 in the bottom of the adapter ring will receive a steel ring gasket for sealing to the blowout preventer top flange, or to another control stack member. The adapter ring shown is suitable for a 12 inch nominal diameter, 3,000 psi blowout preventer. For a 13⅝ inch nominal diameter, 5,000 psi blowout preventer one could substitute the adapter ring shown in FIG. 1A wherein like parts are given the same number except primed.

A tubular boss 27 welded over a port in the side of the body and closed by a screw plug 28 provides access to the interior of the head, e.g. for insertion of instruments run on wire lines. A kelly 29, not part of the head, is shown extending through the head. The head is shown in operating position extending up into the lower part of opening 30 through master bushing 31 set in opening 33 in rotary table 35. It will be seen that the diameter of flange 25 is small enough to pass through opening 33 in the rotary table when the master bushing is removed. It is therefore possible to lower the drilling head (with side outlet removed as hereinafter described) through the rotary table to the top of the control stack. This eliminates the great deal of manipulation required when a drilling head is slid laterally under the rig floor and rotary table. Since a drilling head is such a heavy body, elimination of such manipulation is a great advantage.

Side Outlet

The body of the drilling head is provided at one side (see also FIG. 2) with a rectangular boss 41, which may be welded to the body as shown at 43. A side port 45 extends through body 21 and boss 41. Boss 41 is provided with four unequally spaced (for orientation) threaded holes, such as 47, adapted to receive four cap screws 49 by means of which a tubular side outlet 51 is secured to the body of the head over the side port. At its inner end, side outlet 51 has a rectangular flange 53 which is complementary to rectangular abutment 41 and adapted to seal therewith. At its outer end side outlet 51 has a circular radial flange 55 which provides means for making connection with a mud line or flowing line. Flange 55 has a plurality of holes 57 therethrough to receive bolts for securing the flange to a companion flange on the drilling fluid return line (mud line or blowing line). Flange 55 is provided with an annular groove 61 to receive a steel ring gasket to seal with the companion flange.

A removable and replaceable hard metal bushing or wear sleeve 65 is shrink fitted inside side outlet 51. Rabbet 67 at the outer end of the inner periphery of side outlet 51 receives a radial flange 71 at the outer end of the wear sleeve. An annular space or relief 73 in the side outlet reduces the area of contact between the side outlet and wear sleeve to facilitate assembly and disassembly. Wear sleeve 65 extends through the inner end of the side outlet and (with slight clearance) through port 43 in boss 41 into the interior of the body of the drilling head, terminating at 75. It will be noted that the sides of the wear sleeve are longer than the top and bottom, in order to conform to the shape of the body of the head.

It will be understood that detritus laden drilling fluid flowing upwardly through vertical flow passage 23 in the drilling head must make a right angle turn to exit via side port 43 and side outlet 51. Consequently, there will be considerable turbulence where the fluid leaves through the side of the drilling head body and the hard wear sleeve will reduce the rate of destruction of the head at this location.

Top Closure

Figure 4A:
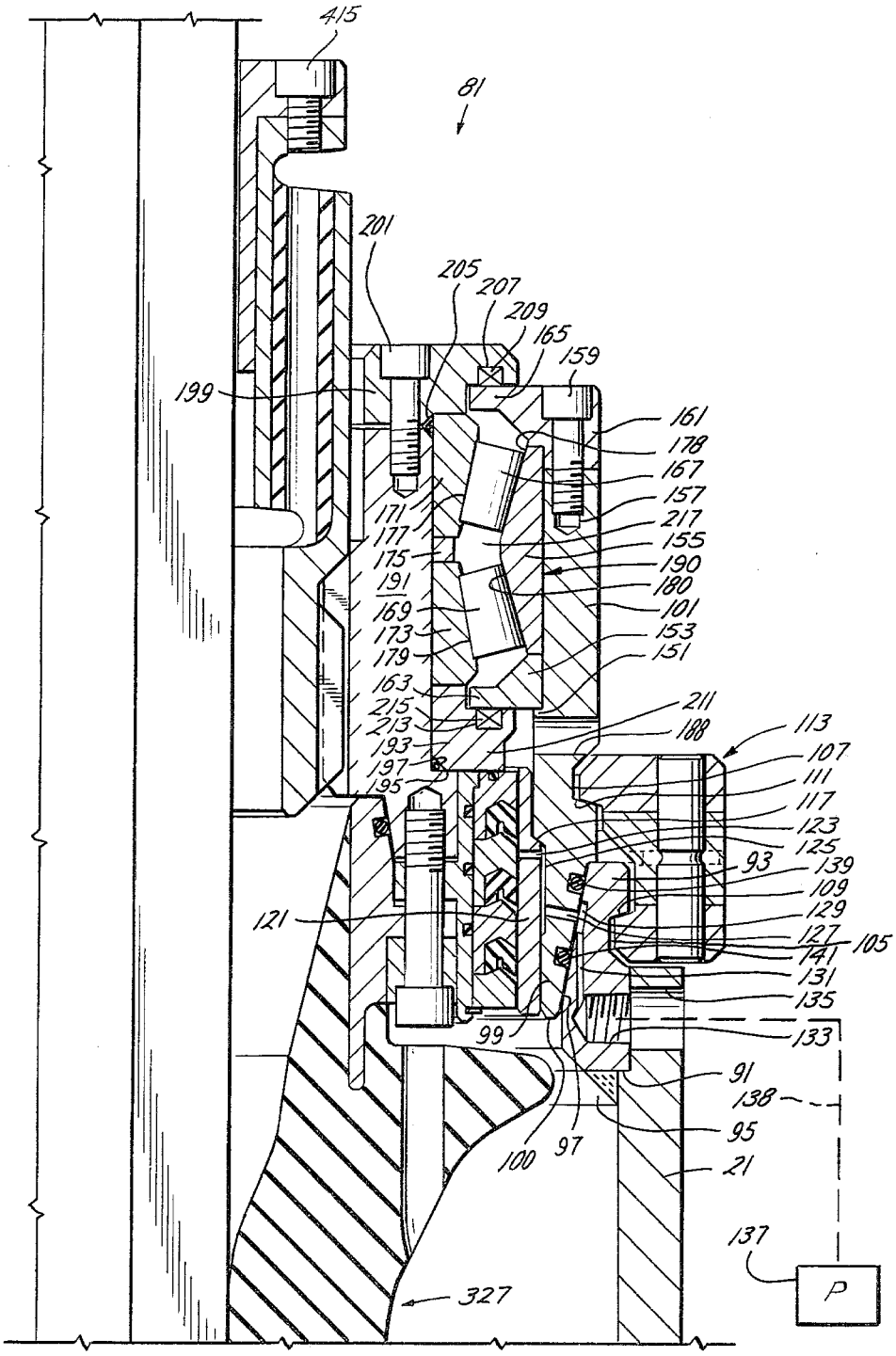
FIGS. 4A and 4B, sometimes hereinafter referred to together as FIG. 4, show a vertical section at plane 4—4 of FIG. 3.
Figure 4B:
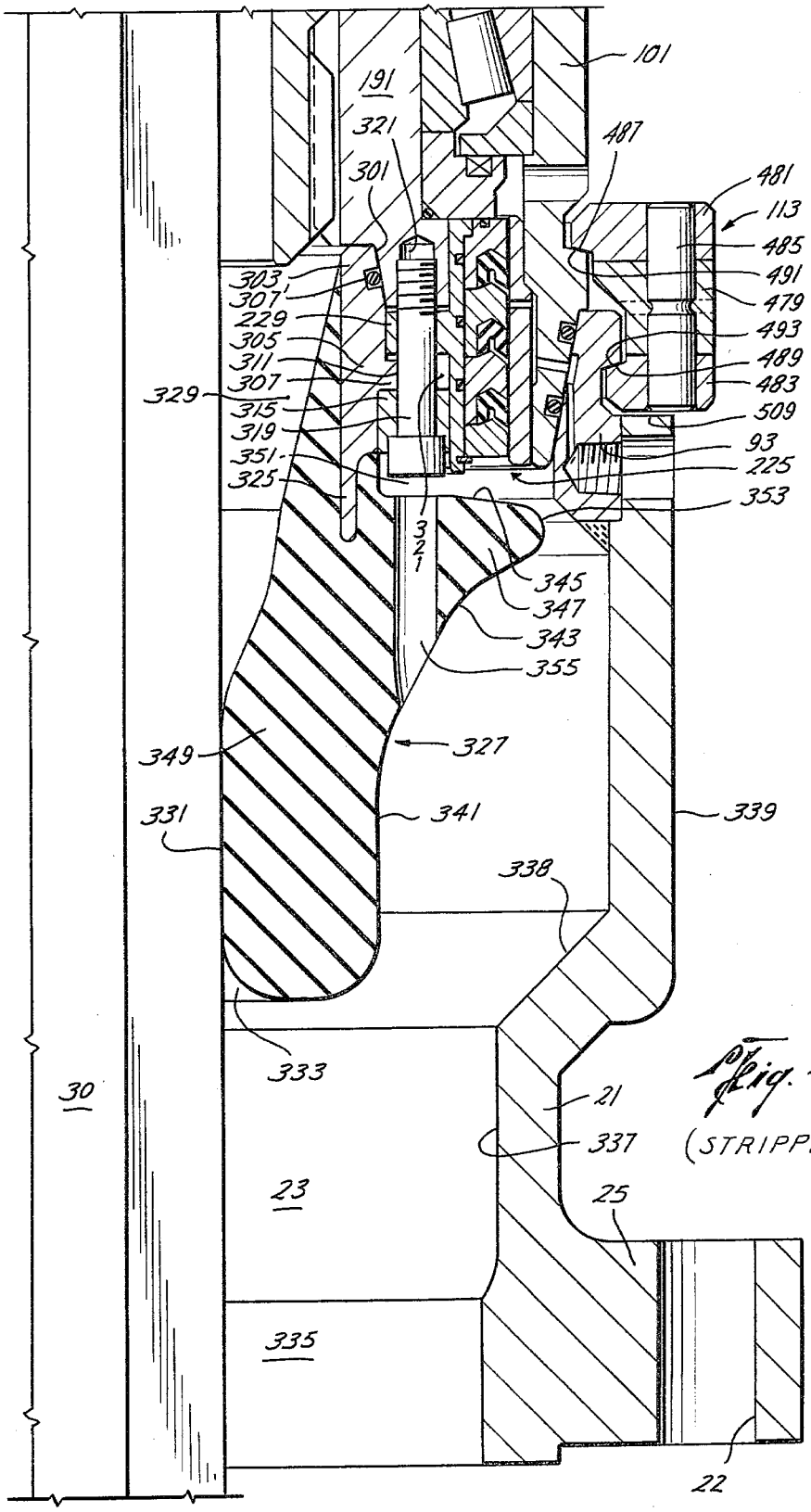

Referring now especially to FIGS. 4A and 4B, to close the annulus between kelly 30 and the upper end of drilling head body 21, there is provided a top closure assembly comprising a number of separable subassemblies. These include:

(a) an outer tube, supporting both the outer bearing race and a replaceable wear sleeve for the stator of the rotating seal;

(b) A seal tube, supporting at its lower end both the replaceable packing of the rotating seal rotor and the replaceable stripper of the resilient, nonrotating, axially slidable seal with the kelly, and at its upper end, the inner bearing race and the outer member of a spline;

(c) A drive bushing comprising an annular elastomer sandwich, with a spline on the exterior of the sandwich, and kelly slips mounted at the inner periphery of the sandwich.

The top closure is releasably secured to the upper end of the drilling head body by a remote controlled hydraulically actuated clamp. The various subassemblies of the top closure will next be described, and thereafter, the hydraulically actuated clamp will be described.

Outer Tube (a) Pin and Bowl Connection to Head

Referring now to FIG. 4A, the upper end of drilling head body 21 is provided with an internal annular shoulder 91. Supported on shoulder 91 is a bowl 93 which is welded to the head body at 95. Bowl 93 has a conical seat 97.

Conically tapered pin 99 at the lower end of an outer tube 101 is supported and centered by seat 97. Pin 99 has a bronze tip 100 brazed to the remainder of the pin thereabove, which is made of steel. Annular external stop shoulder 103 on the outer tube rests on the top of bowl 93 to limit engagement of pin 99 and seat 97 to insure that the pin can easily be removed from the seat. External annular grooves 105, 107 in the head body and outer tube provide tapered shoulders 109, 111 engageable by releasable clamp 113 to hold the outer tube to the head.

(b) Rotating Seal Stator Bushing

A tapered internal annular shoulder 117 in outer tube 101 provides a seat for a hard metal bushing 121 forming the stationary element of the rotating seal. Tube 101 is shrink fitted within the outer tube, whereby it can easily be removed and replaced whenever necessary.

(c) Rotating Seal Lubrication

To facilitate lubrication of the seal surface of bushing 121, there are provided in bushing 121 one or more lubrication ports 123 which communicate with an annular recess 125 in the outer tube. Recess 125 communicates with one or more ports 127 extending radially through outer tube pin 99. Ports 127 communicate with annular groove 129 in the seat of bowl 93. Groove 129 communicates with vertical passage 131 in bowl 93, the latter passage communicating with threaded socket 133 in the side of the bowl. Socket 133 opens to radial port 135 through the body of the drilling head. The outlet of an oil pump, shown schematically at 137, driven by suitable means not shown, is connected via oil line 138 to socket 133 to supply oil to the interior face of bushing 121. O-rings 138, 141 seal pin 99 to bowl 93 to prevent oil leakage. No seal rings are needed between bushing 121 and tube 101 since there are shrink fitted surfaces both above and below recess 125.

Since oil line 138 connects directly to body 21 and only indirectly to outer tube 101, there is no need to disconnect the line when the top closure is pulled from the body of the head when it is necessary to change the drill bit or other large drill string component. Since the clamp securing the top closure to the body is remotely controlled from above the floor of the drilling rig, there is no need for workmen to go below the floor when the top closure is removed and replaced.

(d) Outer Bearing Race Support

Figure 5A:
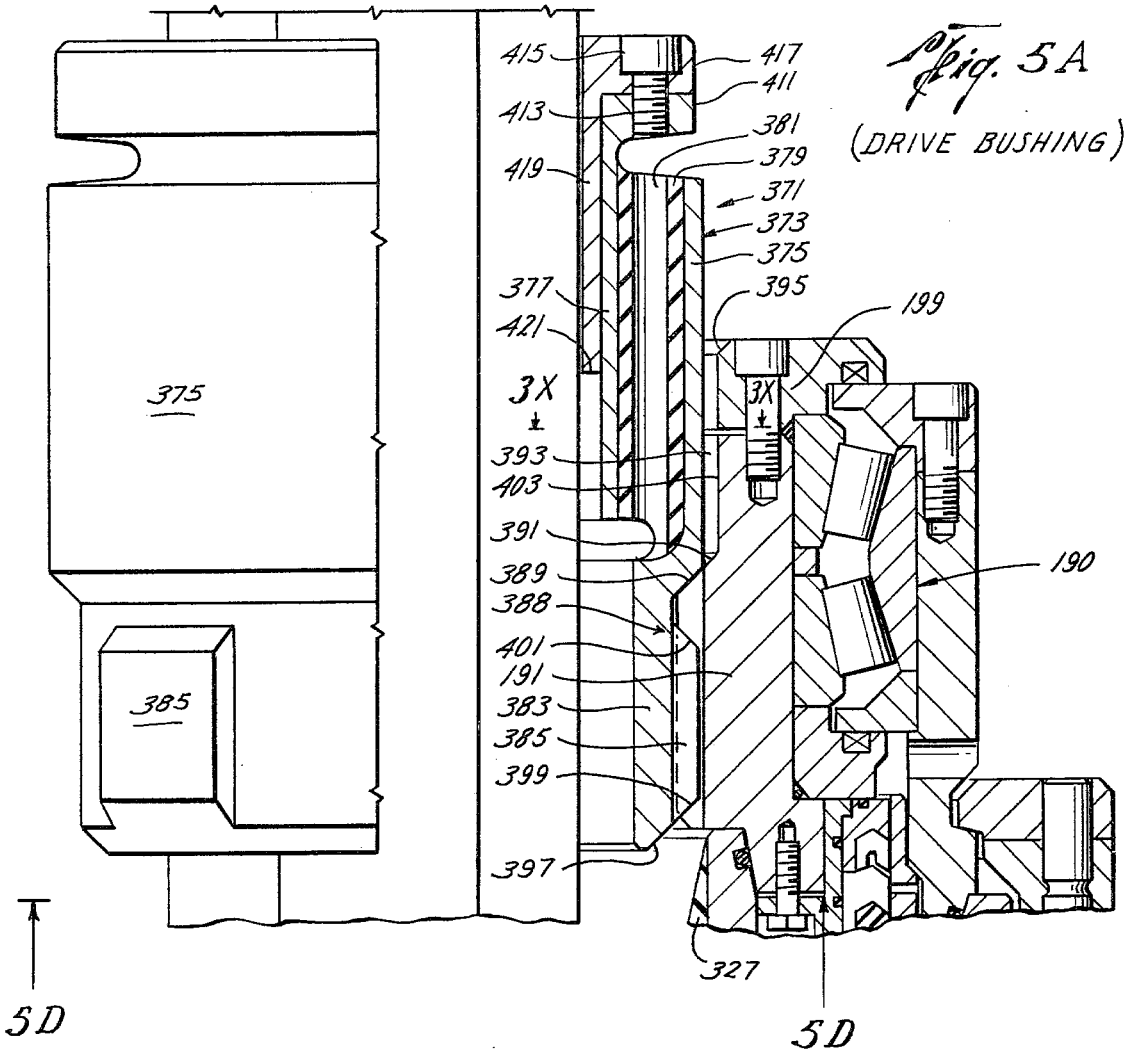
FIGS. 5A and 5B, sometimes hereinafter referred to together as FIG. 5, show a vertical section taken at plane 5—5 of FIG. 3 plus a fragmentary elevation of the drive bushing.
Figure 5D:
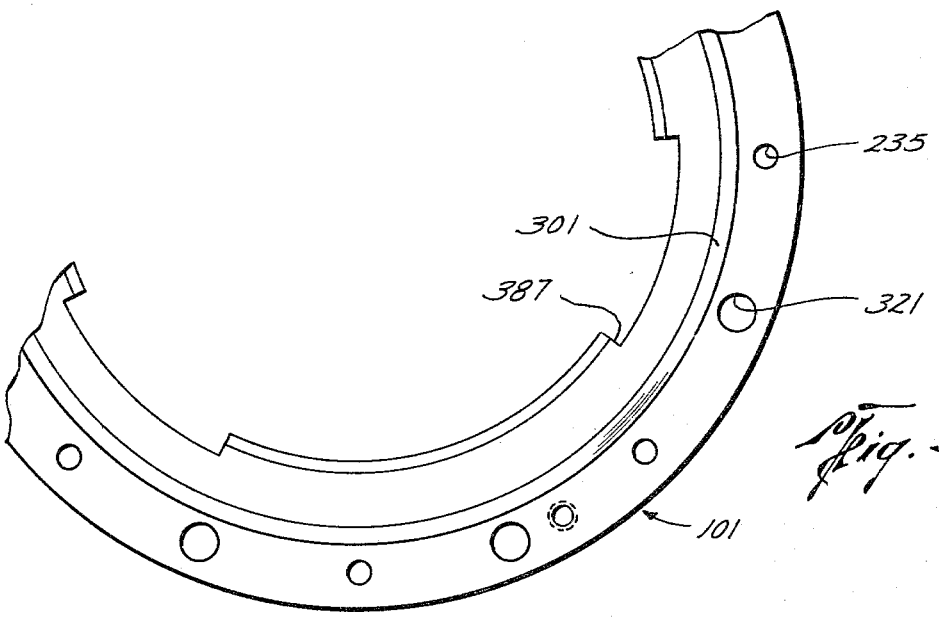
FIG. 5D is a bottom view taken at plane 5D—5D of FIG. 5A showing the seal tube alone.
Figure 5B:
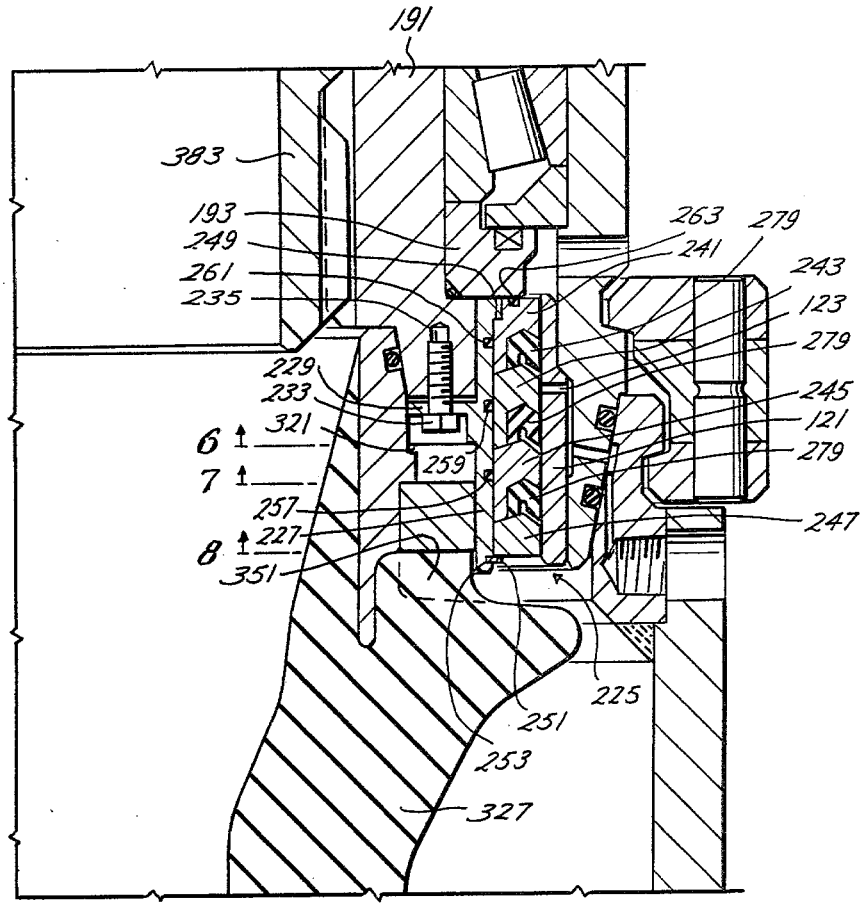

Referring now to FIG. 5B, the upper part of outer tube 101 is provided with an internal annular shoulder 151 on which is seated support ring 153 for outer bearing race 155. The top of outer tube 101 is provided with a plurality of threaded sockets 157 receiving cap screws 159 which secure retainer ring 161 to the outer tube. Retainer ring 161 engages the upper end of outer bearing race 155. The race is thus held between retainer ring 161 and support ring 153. Rings 161 and 153 have annular lips 163, 165 which extend radially inwardly past the upper and lower rings of roller bearing cones 167, 169 to keep out dust and retain grease therearound. Rings 163, 165 radially overlap the ends of upper and lower inner bearing races 171, 173. A spacer ring 175 separates races 171, 173. Races 171, 173 are provided with recessed annular tracks 177, 179 which prevent relative axial motion of these tracks and roller cones 167, 169. The rollers are limited in their axial travel by support ring 153 and retainer ring 165 and the double conical tracks 178, 180 provided at the inner periphery of outer race 155. Therefore, the entire assembly of bearing means 190 stays together as a unit when mounted on the outer tube 101.

To protect the bearings against well fluid and drilling fluid, should there be failure of the rotating seal between the stator and rotor (hereinafter described) a relief port 188 is provided in stator 101 to release such fluid to the exterior of the head.

Seal Tube (a) Inner Bearing Race Support

Rotatably supported by the inner bearing race is a seal tube 191. An end ring 193 rests upon annular external shoulder 195 of seal tube 191 and is sealed thereto by O-ring 197. Another end ring 199 is secured to the upper end of the seal tube by a ring of cap screws 201 extending through holes in the ring and received in threaded sockets 203 in the seal tube. An O-ring 205 seals between ring 199 and seal tube 101.

Inner races 171, 173 and spacer ring 175 of bearing means 190 are captured between end rings 193 and 199. Seal tube 191 is thereby rotatably supported upon outer tube 101 by bearing means 190. Bearing means 190 takes both radial and axial thrust.

Ring 199 has an outer annular lip 205 which has an annular groove 207 in which is disposed a ring of packing material 209. Packing ring 209 rotatably seals between end ring 199 and retainer ring 165. End ring 193 has an outer annular lip 211 providing an annular recess 213 in which is disposed a ring of packing material 215. Packing ring 215 rotatably seals between end ring 193 and support ring 153. By this means the roller cones and their inner and outer tracks are completely sealed, to retain grease 217 with which they are packed, and to exclude dirt. This bearing seal means is separate from and independent of the rotating seal means and the non-rotating seal means (stripper), hereinafter described, which control fluid in the annulus, and relief port 188 heretofore mentioned, prevents annular fluid pressure from being exerted on the bearing seal means.

(b) Rotating Seal Packing Cartridge

Referring now to FIGS. 5A and 6, cylindrical rotating seal packing cartridge 225 telescopes around the cylindrical lower end of seal tube 191 and is secured to the tube as hereinafter described. Cartridge 225 includes a support sleeve 227 having an internal radial flange 229. Flange 229 has a plurality of circumferentially spaced counter sunk holes 231 therethrough adapted to receive cap screws 233 which screw into threaded sockets 235 in seal tube 191. However screws 233 do not draw flange 229 into engagement with tube 191, which remains slightly spaced therefrom.

A plurality of packing support rings 241, 243, 245, 247 around sleeve 227 are loosely captured between shoulder 249 and retainer ring 251 received in groove 253. The packing support rings are compressed against bearing support ring 193 by retainer ring 251 which in turn is drawn toward bearing end ring 193 by cap screws 233 pulling seal support sleeve 227 in that direction. O-rings 257, 259, 261, received in annular grooves in packing support sleeve 227, seal between the packing support sleeve 227 and packing support rings 245, 243, 241. A further O-ring 263 seals between packing support ring 241 and bearing end ring 193.

Figure 5C:
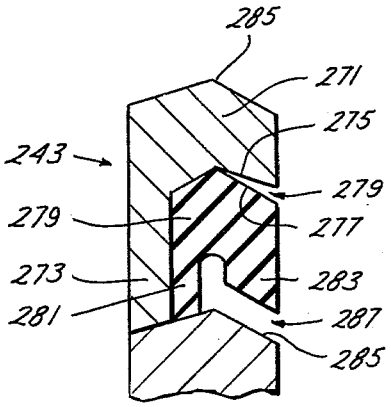
FIG. 5C is an enlarged view of a portion thereof.

Referring now also to FIG. 5C, packing support rings 241, 243, 245 each include a base portion 271 and a spacer neck 273 extending downwardly therefrom to the ring below. Ring 247 is of similar construction except being the lowermost ring it has no neck. The base of each of rings 241, 243, 245 has an annular V-section groove 275 in its lower face adapted to receive the V-section base 277 of one of flexible packing rings 279. The angle of groove 275 is greater than that of base 277 of the packing ring to leave space 279 for the packing ring to flex into. Each packing ring 279 is a double lip seal, having an inner annular lip 281 to seal with neck 273 of the support ring and an outer annular lip 283 to seal with stator bushing 121. The upper side 285 of the base of each packing support ring except 241 is also of V-shape cross-section to conform to the shape of the underside of packing rings 283, thereby to support them better in case they move downwardly under reverse pressure differential or by gravity. However, legs 273 are long enough to keep the upper sides 285 of the packing support rings normally spaced from the lower sides of the packing rings, leaving spaces 287 for the entrance of fluid to exert pressure on lips 281, 283.

It will be seen that cartridge 225 provides a readily replaceable packing means for the rotating seal. Because the soft packing element of the rotating seal is on the rotor, the stator element of the rotating seal and its bushing or wear sleeve 121 can be all metal and it is easier to provide a lubricant passage, e.g. 123, going all the way to the relatively moving surfaces of the rotating seal. It is not necessary to provide a lubricant passage through or around the soft packing of cartridge 225.

Referring once more to FIG. 6, there are four threaded holes 291 in flange 229 of packing support sleeve 227. Threaded holes 291 are in between unthreaded holes 231. If after removing cap screws 233 (FIG. 5), difficulty is experienced in withdrawing packing support sleeve 227 from seal tube 191, e.g. due to the one becoming cocked on the other during use, or sand or other detritus having accumulated between their telescoping surfaces, cap screws (not shown) can be inserted into threaded holes 291 and screwed into engagement with seal tube 191 between threaded sockets 235 to force the packing sleeve off of the end of the seal tube by screw jack action.

(c) Stripper

Figure 8:
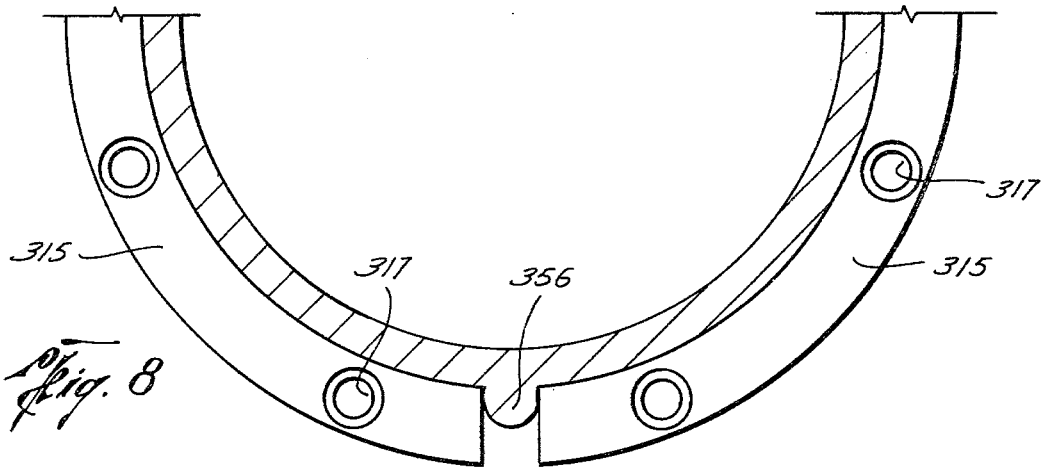
Figure 8A:
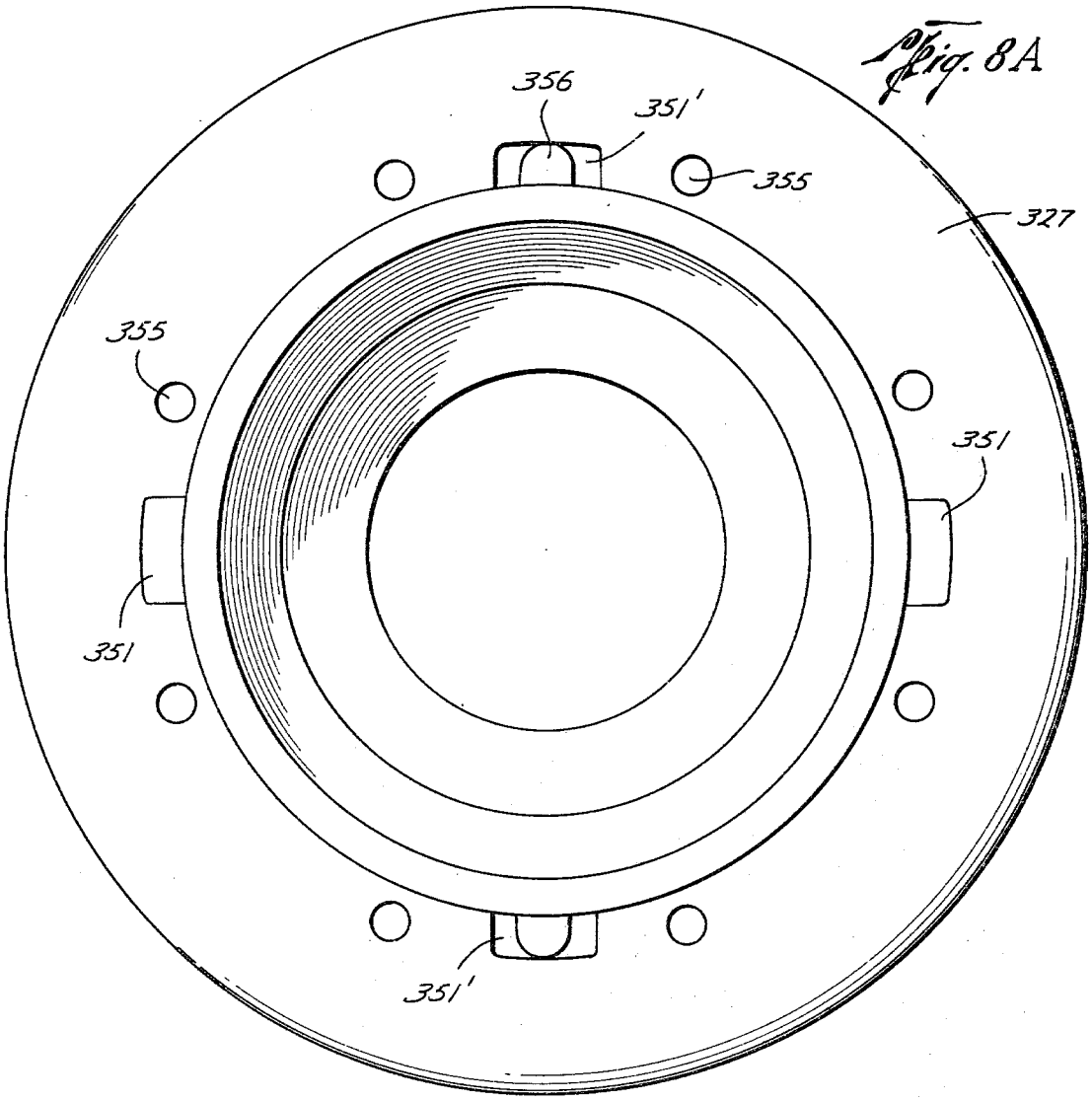
FIG. 8A is a top view of the stripper portion of the drilling head.

Referring now to FIG. 4B, the lower end of seal tube 191 is provided with a conical socket 301 in which is received conical pin 303 on stripper support sleeve 305. An O-ring 307, received in an annular external groove in pin 303, seals between the pin and socket. Referring now also to FIG. 7, support sleeve 305 is provided with a narrow external radial flange 307. Beneath flange 307 on stripper support sleeve 305 are the two halves of a split retainer ring 315. As shown in FIG. 8, retainer ring 315 has a plurality of unthreaded countersunk holes 317 therethrough, in register with holes 313 (FIG. 6). Through these sets of registering holes and past the outer periphery of flange 307 pass a plurality of cap screws 319 (FIGS. 4B and 7). Cap screws 319 screw into threaded sockets 321 in seal tube 191. When cap screws 319 are tightened, their heads bear against the bottoms of the countersinks in split ring 315 and draw ring 315 against flange 307, thereby forcing pin 303 tightly into socket 301 in sealing engagement therewith. Space 321 between flange 307 on the stripper support sleeve and flange 229 on the packing support sleeve will remain even when cap screws 319 are tightened, so that there is no interference with proper seating of pin 303 in socket 301. This tight engagement prevents wobble during drilling operations. On the other hand, since the taper angle of the pin and socket is greater than a seizing taper, the pin is easily freed from the socket when screws 319 are removed. It will also be noted that screws 319, when in place, contribute to the stability of both the packing support sleeve and the stripper support sleeve. In addition, the packing support sleeve extends around the two halves of split ring 315 and prevents it from moving radially outwardly.

Stripper support sleeve 305 has a depending skirt 325. Molded about and bonded to skirt 325 and the lower end and inner periphery of sleeve 305 is stripper 327. Stripper 327 is a tubular body of flexible resiliently stretchable material such as an elastomer, e.g. natural or synthetic rubber. The inner periphery of stripper 327 at 329 tapers inwardly from the upper end of the stripper to the mid-portion thereof. Below tapered surface 329 the inner peripheral surface 331 of the stripper is cylindrical. The inner periphery of the stripper is therefore funnel shaped, facilitating downward passage of a tool joint 332, 332' therethrough (see FIG. 5E), e.g. when the drill string is being reassembled and lowered into the hole after changing bits, or when the drill string is being lowered into the hole after another length of pipe 334 has been added between the kelly and the uppermost piece of drill pipe in the string, as the hole is drilled deeper.

The lower end of stripper 327 is rounded at 333 to facilitate entrance of tool joints when the drill string is raised, either to add pipe or change the bit. Still referring to FIG. 4B, it will be noted that flow passage 23 through drilling head body 21 is of varying diameter, being smallest at 335 at the lower end inside flange 25. This smallest diameter portion may be called the mouth of the drilling head. Well below the lower end of the stripper, the flow passage widens out into throat 337. Adjacent the lower end of the stripper, the flow passage diameter increases still more at 338, joining with a large diameter portion 339 forming the belly of the drilling head. The increasing diameters assure that there is no throttling of the drilling fluid as it rises in the drilling head and turns to exit via side outlet 51 (FIG. 1). The belly of the drilling head surrounds the cylindrical lower outer peripheral surface 341 and the upwardly flaring medial outer peripheral surface 343 of the stripper and is far enough removed therefrom to allow the stripper to expand over a tool joint without blocking the flow passage to the side outlet (see FIG. 5E).

Still referring to FIG. 4B, above flaring medial outer peripheral surface 343 of the stripper, there is transverse surface 345, extending below and somewhat spaced from packing cartridge 225 and cap screws 319. There is thus formed a medial radial flange 347 about the generally tubular body 349 of the stripper. Flange 347, extending beneath the rotating seal and beneath the stripper and packing support sleeve assemblies, shields them from the upwardly flowing drilling fluid. The flaring lower surface 343 of the flange serves to guide the drilling fluid to side outlet 51 (see FIG. 1), thereby reducing turbulence and consequent wear and erosion.

Figure 5E:
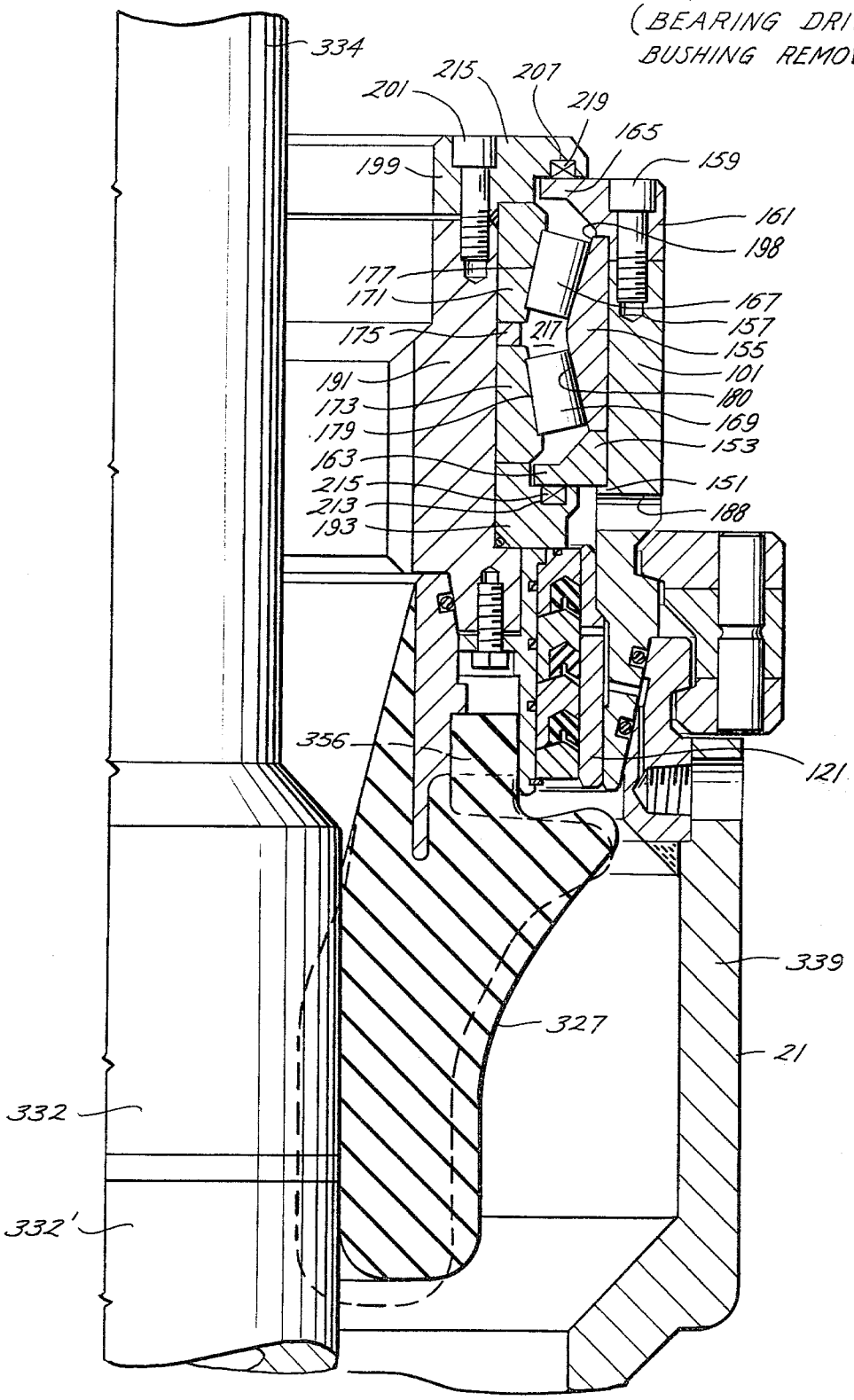
FIG. 5E is a section taken at plane 5E—5E of FIG. 3, and showing a tool joint passing through the head.

Space 351 between the upper surface 345 of the flange and the lower end of the rotating seal and support sleeve assembly allows the rounded flange tip 353 to move upwardly as the lower part of the stripper expands (see FIG. 5E).

A plurality of circumferentially spaced holes 355 in stripper 327 are in register with cap screws 355. A tool (not shown) such as a screw driver with a socket wrench tip, can be passed upwardly through holes 355 to unscrew or tighten cap screws 319. However, the holes are smaller in diameter than the heads of the cap screws so that should a screw come loose when the drilling head is in use it will not fall down into the well annulus. Since the holes are smaller than the heads of the screws, the screws cannot be passed therethrough when the stripper is to be connected to the seal tube. Instead, screws 319 are passed through holes 317 in split ring 315 while the two halves of ring 315 are separate from the stripper. Then the two halves are placed about stripper support sleeve 305 above four elevator lugs 356 (see FIG. 5B) on stripper flange 317, and the assembly is connected to seal tube 191 by cap screws 319 (see FIG. 4B). To assure registry of cap screw holes 317 in the split ring with tool access holes 355 in the stripper, the two halves of the split ring are of less than 180 degrees extent and stripper 327 is provided with two orientation lugs 356 (FIGS. 5E and 8) extending between the two halves.

Although the lower inner peripheral surface 331 of the stripper is cylindrical, the stripper is sufficiently soft and resilient to form a seal with a non-circular drive tube, e.g. with a square cross-section kelly or with a hex cross-section kelly 30 as shown. Stripper 327 thus provides means to make an axially slidable, non-rotating seal with a kelly or other drive tube. Preferably, stripper 327 is made of an elastomer having a durometer hardness on the Shore A scale of between 45 and 85, e.g. 55 to 60. The stripper material should be resistant to oil, salt water, well gas and acid. A material such as natural rubber would be suitable. A nitrite rubber or a urethane could be used where a high oil content is expected.

(d) Drive Bushing

In order to insure that there is no relative rotation of the stripper and kelly (or other drive tube), provision is made for driving the seal tube in synchronism with the kelly. This is effected by means of drive bushing 371 (FIG. 5A). The drive bushing includes an annular elastomer sandwich 373 comprising an outer steel sleeve 375, an inner steel sleeve 377 and a sleeve 379 of rubber or other elastomer therebetween bonded thereto. Preferably sleeve 379 has longitudinally extending holes 381 azimuthally spaced apart (view 3S-3X in FIG. 3), to facilitate molding without overstressing, as described in U.S. Pat. No. 3,033,011—Garrett. The holes also provide vents which prevent any build-up of pressure underneath the drive bushing which might force it upwardly out of the drilling head. Sleeve 379 should be made of a material that is resistant to salt water, oil, well gas and acid, similar to the material of stripper 327 and preferably will have a durometer hardness in the range of 50 to 90 on the Shore A scale.

Outer sleeve 375 has a neck 383 depending therefrom, of smaller outer diameter than the upper part of sleeve 375. On the exterior of neck 383 are three azimuthally spaced splines 385 which mesh with three correlative splines 387 azimuthally spaced apart on the inner periphery of the seal tube. There is thus provided spline means 388 connecting the drive bushing and seal tube. Tapered shoulder 389 at the juncture of the upper part of outer sleeve 375 and neck 383 rests on the tapered upper ends of seal tube splines 387. The tapered upper ends of splines 387 merge with tapered shoulder 391 between the upper and lower parts of seal tube 191. Shoulder 391 helps center the drive bushing splines when the drive bushing is lowered into the seal tube, there being annular clearance 393 between the outer periphery of outer sleeve 375 and the inner periphery of seal tube 191 to facilitate entrance of the drive bushing into the seal tube. To the same end, there is a guide bevel 395 around the inner periphery of the top of bearing end ring 199, and the lower ends of neck 383 and splines 385 are also collinearly beveled, as shown at 397, 399. To avoid catching on removal of the drive bushing, the upper ends of splines 385 are beveled at 401. It will be apparent therefore that drive bushing 371 is easily insertable in, engageable with and removable from the socket 403 formed at the inner periphery of the seal tube. FIG. 5E shows the drive bushing removed; whereas, FIGS. 4A, 4B, 5A, and 5B show the drive bushing engaged with the socket.

The upper end of inner sleeve 377 of the drive bushing has an external radial flange 411 which extends over the top of the elastomer sleeve 379 and keeps dirt from falling into holes 381. A plurality of threaded holes 413 azimuthally spaced apart around flange 411 receive cap screws 415. Screws 415 extend through countersunk holes in radial flanges 417 (see also FIG. 3) on kelly slips or inserts 419 and releasably secure the slips to the inner sleeve of the drive bushing. The two slips 419 together form a diametrically split ferrule whose inner periphery has a cross-section correlative to that of the drive tube to be used with the drilling head. As shown, the cross-section is hexagonal to conform to hex kelly 29.

When slips 419 are removed, inner sleeve 377 of the drive bushing will pass over the connector (tool joint member) at the lower end of the kelly. Thereafter, when the slips are inserted between the kelly and inner sleeve of the drive bushing and fastened in place, the kelly can slide up and down within the drive bushing but not clear through it, being limited in its travel by the connectors at its ends. When the drill string is elevated to add a length of pipe or to change the drill bit, the kelly is elevated and the connector at its lower end will engage the lower ends 421 of the slips. This will not prevent further elevation of the kelly for further movement will merely lift the drive bushing out of its socket. The larger diameter opening left when the drive bushing is removed will leave plenty of room for the tool joint on the uppermost length of drill pipe to pass (See FIG. 5E). Although such tool joint will normally be no larger in diameter than the connector at the lower end of the kelly, it might be out of shape, so it is of advantage to have a larger opening rather than trying to thread the tool joint through the smaller opening that would be left if only the slips were removed instead of the entire drive bushing. Incorporating the shock absorber elastomer sandwich 273 in the drive bushing is therefore of advantage.

It will be noted from FIG. 1 that drive bushing 373 extends up inside master bushing 31 in rotary table 35. Utilization of this available space by elevating shock absorber sandwich 273 above spline means 388 makes possible a reduction in diameter of the bearing means 190, which is inboard with respect to belly 339 of the drilling head body. Bearing means 190 can therefore pass through small size rotary tables too small to pass the body of the drilling head. When it is desired to change bits, master bushing 31 is removed from the rotary table, clamp 113 is opened, and the entirety of top closure 81 is lifted out of the drilling head. To facilitate such removal, bearing end ring 199 is provided with threaded holes 450 into which screw eyes may be inserted for aid in lifting the top closure. Unless it is desired to keep the annulus closed while pulling the drill string, the top closure can be removed at the beginning of the trip, engagement of the kelly connector with the lower end of the stripper causing the entire top closure to be drawn out with the kelly.

Summarizing, the drilling head is stratified as follows, proceeding from the top down:

level 1: Kelly slips and shock absorber
level 2: Drive bushing spline and bearing
level 3: Stripper support, rotating seal, and clamp
level 4: Stripper, belly and side port
level 5: Mouth and mounting flange.

By so disposing the components, the maximum use is made of the vertical space beneath the rotary table, enabling the whole head to be lowered and raised through the more common 27½ inch A.P.I. rotary table and the top closure to be lowered and raised through the smaller 17½ inch A.P.I. rotary table.

CLAMP

Figure 2:
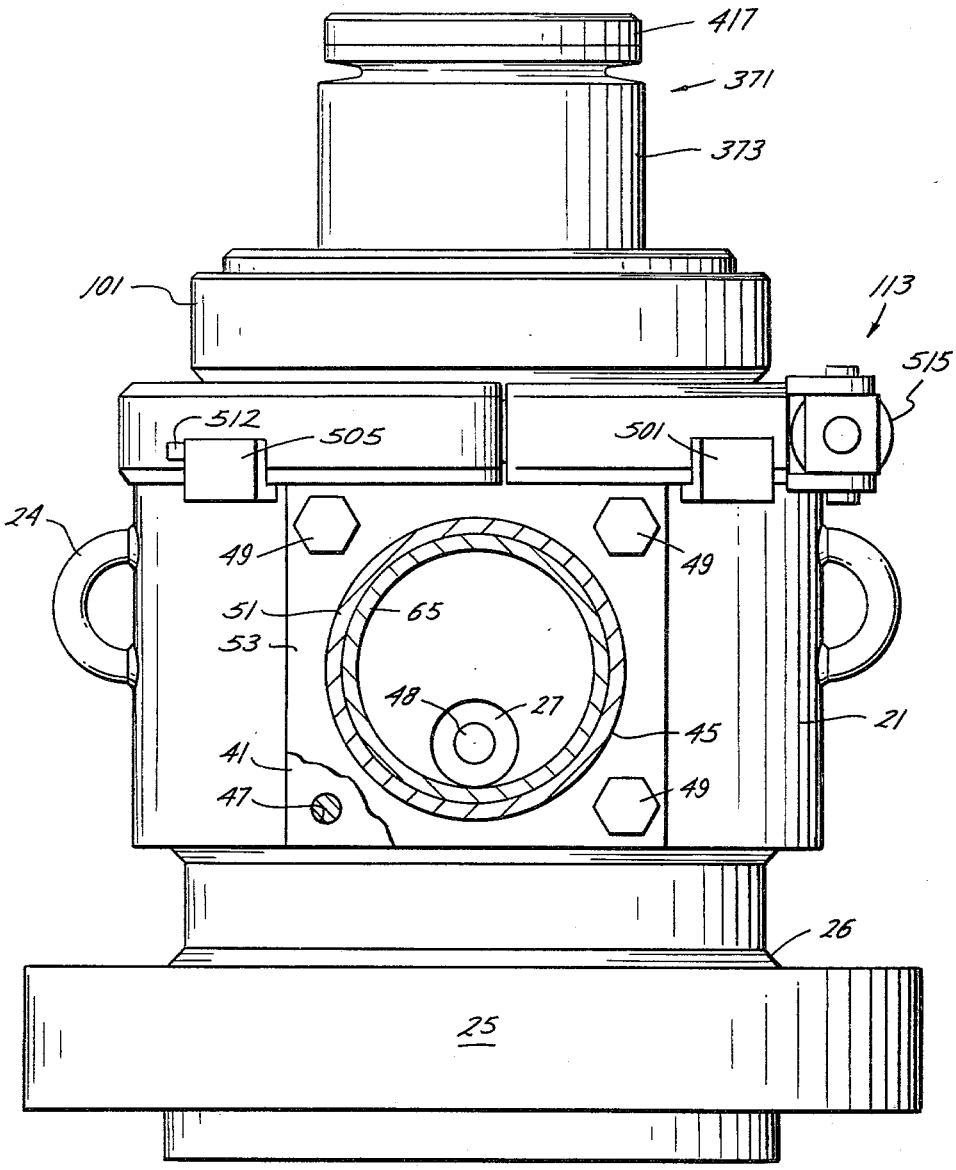
FIG. 2 is a section taken on plane 2—2 of FIG. 1.
Figure 3:
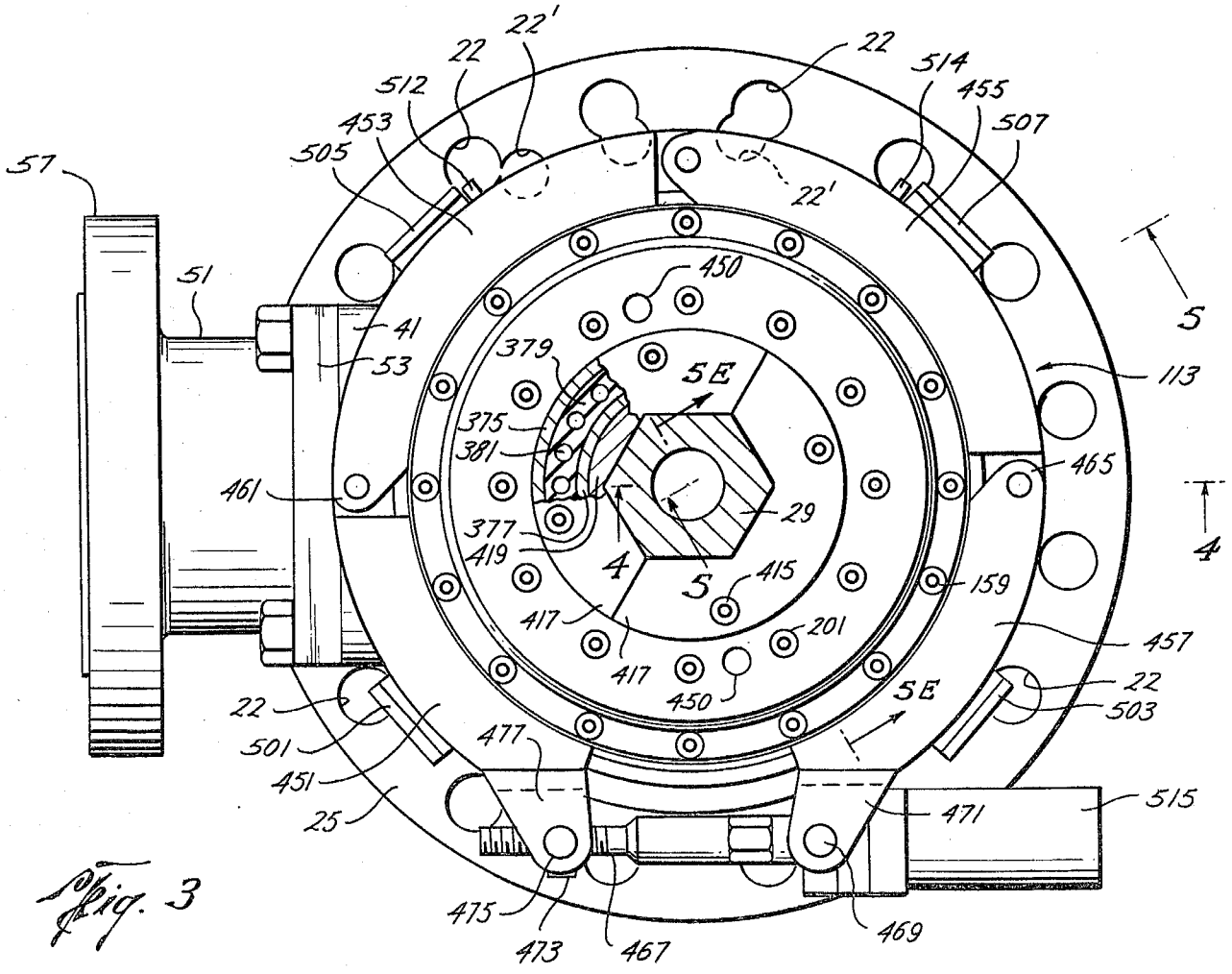
FIG. 3 is a top view of the drilling head partially broken away at plane 3X—3X of FIG. 1.

Referring now to FIGS. 1, 2, and 3, esp. FIG. 3, means 113 to clamp the top closure stator to the body of the drilling head comprises a segmented ring which is divided into four less than ninety degree, (e.g. 80 degree) arcuate segments 451, 453, 455, 457. The four segments are pivotally connected together by three knuckle joints 461, 463, 465 and by a screw 467. Screw 467 is pivotally connected by means (hereinafter described) including cap screws 469 (see also FIG. 10) to ears 471 on segment 451. Screw 467 is engaged with nut 473 which is pivotally mounted by cap screws 475 (see also FIG. 9) to ears 477 on segment 457. As shown best in FIG. 4B, each knuckle joint 461, 463, 465 includes an inner projection 479 on one segment extending between two outer projections 481, 483 on the adjacent segment and a pin 485 extending through holes in the projections and making a drive fit with the inner or outer projections and a freely rotating fit with the other. Other forms of pivotal connection or hinge means could be employed. FIG. 4B also shows that each clamp segment is of C cross-section providing upper and lower internal bevels 487, 489 to engage correlative annular bevels 491 on outer tube 101 of the top closure stator and 493 on bowl 93 in drilling head body 21. It will be seen therefore that when screw 467 is turned to enter nut 473 it will draw the clamp ring segments 451, 453, 455, 457 tightly about the bowl 93 and outer tube 101 and the bevels will wedge bowl 93 and outer tube 101 together, forcing pin 99 into sealing engagement with seat 97.

When it is desired to release the clamp, screw 467 is turned in the opposite direction from that used in tightening the clamp. Such turning of the screw separates ears 471 and 477, segments 451, 457 pivoting about knuckle joints 461, 465 until the segments engage stops 501, 503. These stops are radially spaced from the segments when the latter are drawn up tight as shown in FIG. 3. After segments 451, 457 engage guide stops 501, 503, further separation of ears 471, 477 causes segments 451, 457 to slide longitudinally past stops 501, 503 and push tungentically on knuckle joints 461, 465, thereby moving clamp ring segments 453, 455 away from the center of the drilling head, guide stops 505, 507 insuring uniform outward motion of the segments and ultimately limiting their motion to just far enough to free the top closure without the clamp ring dropping off beyond top 509 (FIG. 4B) of drilling head body 21. The clamp ring therefore remains in a position for reengagement with the top closure whenever desired. A further limit on circumferential expansion of the clamp ring can be provided by one or more stop nuts 511 (FIG. 1) screwed onto screw 467.

When screw 467 is turned to contract the clamp ring, the ring will be oriented relative to ears 501, 503, 505, 507 by radial pins 512, 514 engaging ears 503, 505.

In order to facilitate manual turning of screw 467 it is provided with hexagonal wrench flats 513. However, manual turning of the screw would be for adjustment purposes or use in an emergency, since normally the screw is to be rotated by a hydraulic motor 515. It is to be noted that motor 515 is a rotating motor, operating on a screw, as distinct from a simple hydraulic cylinder operating directly; therefore, should hydraulic pressure to the motor fail, the clamp ring will not be released and there will be no unexpected disassembly of the drilling head. However, the clamp ring can always be released manually should the hydraulic pressure fail and should it be desired to disconnect the drilling head top closure from the body.

Figure 9:
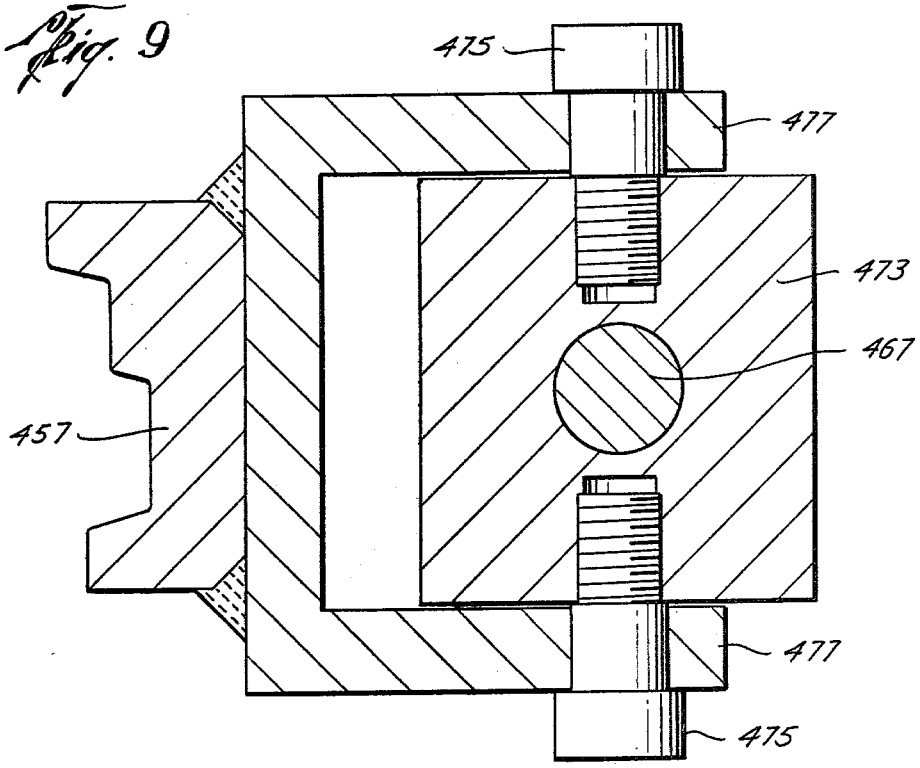
FIGS. 9, 10 and 11 are sections taken at planes 9—9, 10—10 and 11—11 of FIG. 1.
Figure 11:
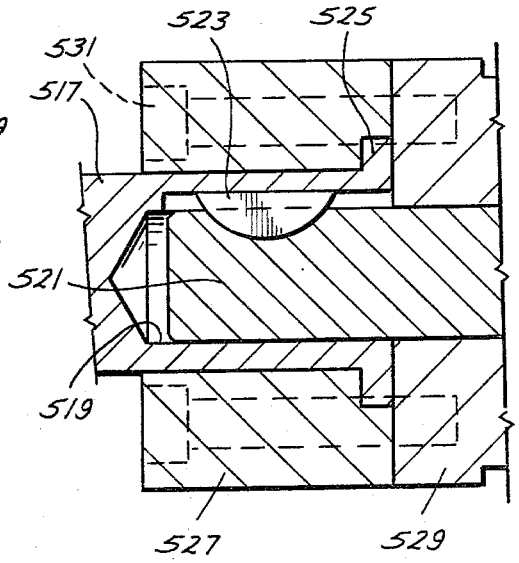

Referring to FIGS. 1, 8, and 9, screw 467 has a larger diameter unthreaded portion 517, on which are formed the previously mentioned wrench flats 513. Larger diameter portion 517 has a socket 519 (FIG. 11) in its end, within which is received rotor shaft 521 of the hydraulic motor. Shaft 521 is secured against rotation relative to screw portion 517 by key 523. Shaft 521 is secured against axial motion relative to screw portion 517 by a flange 525 on the screw portion being clamped by cap 527 to hydraulic motor housing 529. Cap 527 is held to housing 529 by four screws 531. The motor housing is itself prevented from rotation about the motor axis by its square cross-section (FIG. 10) being received between ears 471 and by the motor housing being pivotally mounted between the ears by screws 469. Screws 469 allow pivoting about the axis of the screws but prevent rotation of the motor housing about the axis of shaft 521.

Figure 12:
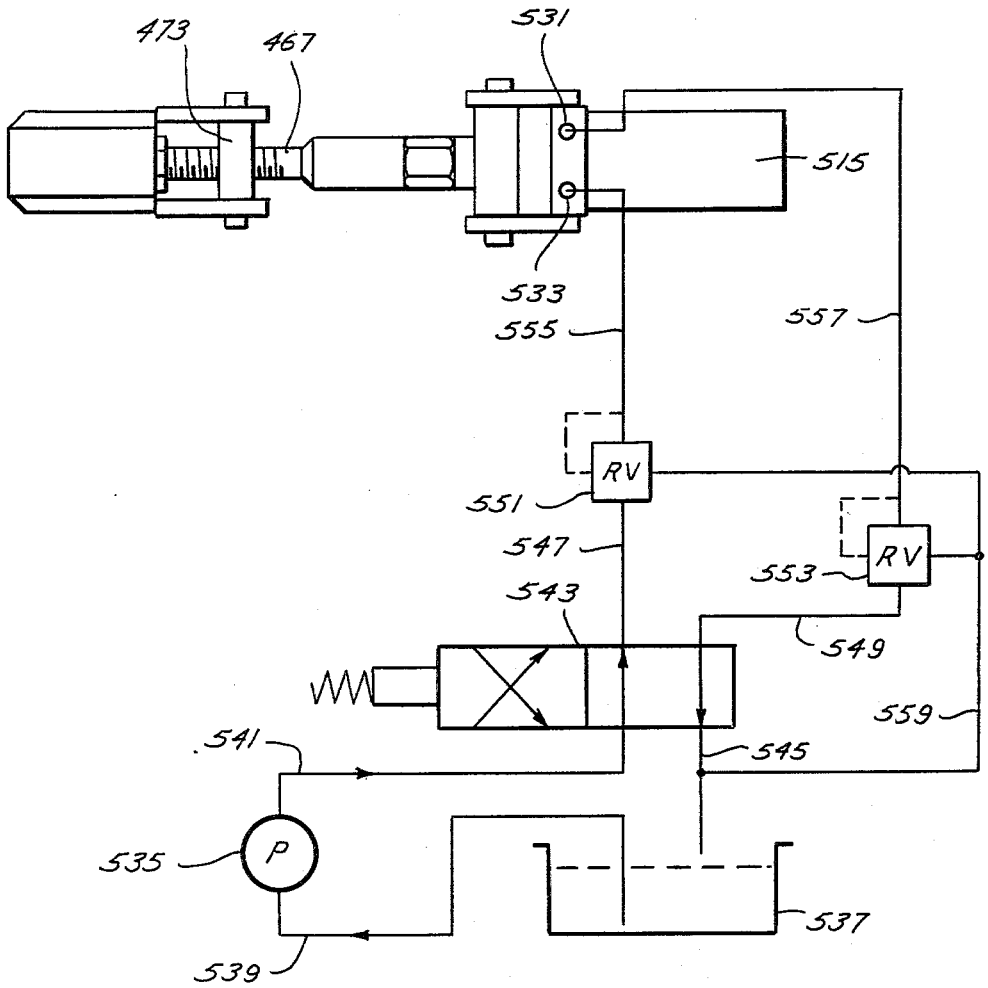
FIG. 12 is a schematic diagram showing the hydraulic circuit of the hydraulically actuated connector of the drilling head.

Hydraulic fluid is supplied to motor 515 via lines connected to ports 531, 533 (FIG. 1). Referring now to FIG. 12, there is shown a suitable hydraulic circuit for operating motor 515. A pump 535 draws fluid from reservoir 537 via line 539 and delivers it via line 541 to reversing valve 543. Valve 543 is also connected to reservoir 539 via line 545. Lines 545 and 541 are connected by valve 543 to lines 547, 549, which connect through relief valves 551, 553 to lines 555, 557. The latter lines connect to ports 533, 531 of hydraulic motor 515. Excess pressure relief valves 551, 553 connect via line 559 to hydraulic fluid reservoir 537. By shifting valve 543, motor 515 can be caused to turn in either clamp engaging or clamp disengaging direction. By turning pump 535 on and off, motor 515 can be shut down or caused to operate as desired.

While a preferred embodiment of the invention has been shown and described modifications thereof can be made by one skilled in the art without departing from the spirit of the invention.

We claim:

1. Drilling head comprising, a tubular body adapted at its lower end for connection to the top of a drilling control stack and having a seat at its upper end to receive top closure means, top closure means including a removable stator having a seating surface releasably supported on said seat, a rotor carrying first replaceable seal means for making a rotating seal with the stator and second replaceable seal means for making an axially slidable seal with a kelly and replaceable bearing means for rotatability supporting the rotor by the stator with respect to both radial and axial thrust, drive bushing means carried by the rotor for axially slidably engaging a kelly to transmit torque from the kelly to the rotor, and spline means on an outer periphery of said drive bushing and an inner periphery of said rotor whereby said drive bushing can be released from said rotor and reengaged therewith whenever desired, said tubular body including a radial flange at its lower end adapted for connection to the flange on the upper end of an adjacent member of a control stack, said tubular body having an opening at its lower end of a preselected internal diameter that is as large as the internal diameter of such adjacent element of a control stack with which the body is to be connected, said opening of said preselected diameter forming the throat of the drilling head, said tubular body having above said throat and outboard of said top closure means a belly portion of smaller outer diameter than said radial flange but of larger internal diameter than said throat adapted to receive said first replaceable seal means when the latter is flexed outwardly, e.g. by a large diameter drill stem member therewithin, said seating surface on said stator being of smaller diameter than the largest inner diameter of said belly portion, said seat in said body for receiving said top closure means being inboard of said belly portion to receive said seating surface, A replaceable metal bushing carried by said stator on the interior of the stator and colevel with said seat and seating surface adapted on its inner periphery to rotatably engage the outer periphery of said first replaceable seal means for making a rotating seal, said spline means and bearing means being colevel and above said rotating seal and said seat and seating surface.

2. Drilling head according to claim 1, releasable means for securing said stator to said body, and means to seal between said stator and body, said seat in said body being a conical seat and said seating surface on said stator being a tapered pin adapted to engage said seat, said means to seal between said stator and body comprising annular groove means in one of said seat and pin and seal ring means in said groove means extending into contact with the other of said seat and pin, said groove means comprising an upper groove and a lower groove, said seal means comprising a seal ring in each of said grooves, and lubricant passage means extending from the exterior of said body upwardly to said body seat through said stator pin between said upper and lower grooves and to said rotating seal, said lubricant passage means extending through said bushing to the outer surface of said packing means carried by the rotor.

3. Drilling head according to claim 2, said releasable means including releasable clamp means and remote controlled motor means for operating the clamp means, whereby said top closure can be removed from said body and reinstalled therein without going beneath the rig floor to get alongside of the drilling head to operate the clamp means and disconnect the lubricant passage means from the stator.

4. Drilling head according to claim 1, said bearing means comprising an outer bearing race means releasably secured to said removable stator and an inner bearing race means releasably secured to said rotor and rotatable bearing elements between said races, said bearing elements including an upper ring of downwardly tapering roller cones and a lower ring of upwardly tapering roller cones, and including a vent through said stator below said bearing races, and means including rotating seals sealing between said inner and outer races at the upper and lower ends thereof to retain lubricant between the races and exclude dirt and drilling fluid and detritus leaking past said rotating seal between the stator and rotor and leaking past said sliding seal between said rotor and kelly, whereby any such leakage will exit via said vent and through said spline means.

5. Drilling head comprising a tubular body and a top closure quickly releasable and removable therefrom, said tubular body being adapted at its lower end for connection to the top of a drilling control stack disposed beneath the floor of a drilling rig, said tubular body having an upwardly facing conical seat at its upper end to receive said top closure means through the rotary table at the rig floor, said top closure means including a stator and a rotor and replaceable bearing means therebetween said stator having a conical seating surface releasably supported on said conical seat, and a replaceable metal bushing for making a rotating seal with said rotor, said rotor carrying first replaceable packing means for making a rotating seal with the inner periphery of said bushing and second replaceable seal means for making an axially slidable seal with a kelly, said bearing means rotatably supporting the rotor by the stator with respect to both radial and axial thrust, releasable means for securing said stator to said body, means to seal between said stator and body comprising upper and lower annular grooves in one of said conical seat and sealing surface and a seal ring in each of said grooves, lubricant passage means extending from the exterior of said body to said body seat and through said body seat and stator seating surface between said upper and lower grooves and said seal rings to the interface between the inner periphery of said stator bushing and the outer periphery of said rotor packing means, said releasable means including releasable clamp means and remote controlled motor means for operating said clamp means.

* * * * *

UNITED STATES PATENT AND TRADEMARK OFFICE

CERTIFICATE OF CORRECTION

PATENT NO. : 4,285,406

DATED : August 25, 1981

INVENTOR(S) : David E. Young & William R. Garrett

It is certified that error appears in the above—identified patent and that said Letters Patent is hereby corrected as shown below:

Column 1, line 5: change "APPLICATION" to -APPLICATIONS-.

Column 1, line 31: after "69,323" insert -filed 8-24-79),-.

Column 4, line 21: change "inventions" to -inventions,-.

Signed and Sealed this

*Twenty-third* Day of *March 1982*

|SEAL|

*Attest:*

GERALD J. MOSSINGHOFF

*Attesting Officer*

*Commissioner of Patents and Trademarks*